US007000440B2

(12) United States Patent
Martin

(10) Patent No.: US 7,000,440 B2
(45) Date of Patent: Feb. 21, 2006

(54) ROTARY SECURITY SYSTEM

(76) Inventor: John Calhoun Martin, P.O. Box 434, Hunt, TX (US) 78024

( * ) Notice: Subject to any disclaimer, the term of this patent is extended or adjusted under 35 U.S.C. 154(b) by 93 days.

(21) Appl. No.: 10/456,924

(22) Filed: Jun. 9, 2003

(65) Prior Publication Data

US 2004/0244443 A1 Dec. 9, 2004

(51) Int. Cl.
*E05B 65/06* (2006.01)

(52) U.S. Cl. ..... 70/129; 70/121; 70/134; 292/153; 292/205; 292/148

(58) Field of Classification Search ..... 70/129–134, 70/DIG. 63, 121, 135; 292/54, 148, 153, 292/205

See application file for complete search history.

(56) References Cited

U.S. PATENT DOCUMENTS

| | | | | | |
|---|---|---|---|---|---|
| 1,213,863 | A | * | 1/1917 | Goins | 292/120 |
| 1,260,469 | A | * | 3/1918 | Smith | 292/153 |
| 1,391,357 | A | * | 9/1921 | Baer | 70/310 |
| 2,666,660 | A | * | 1/1954 | Youngworth | 292/68 |
| 2,707,125 | A | * | 4/1955 | Ritter, Sr. | 292/341.15 |
| 2,856,220 | A | * | 10/1958 | Easley | 292/148 |
| 2,963,895 | A | * | 12/1960 | Thomas | 70/14 |
| 3,656,789 | A | * | 4/1972 | Ray | 292/304 |
| 3,731,505 | A | * | 5/1973 | Rosenberg et al. | 70/63 |
| 3,889,497 | A | * | 6/1975 | Tuttle | 70/14 |
| 3,906,760 | A | * | 9/1975 | Parker, Jr. | 70/154 |
| 3,926,018 | A | * | 12/1975 | Joersz | 70/19 |
| 3,988,031 | A | * | 10/1976 | Meyer | 292/153 |
| 4,085,599 | A | * | 4/1978 | Fischer et al. | 70/14 |
| 4,167,281 | A | * | 9/1979 | Spencer | 292/216 |
| 4,240,278 | A | * | 12/1980 | Linder | 70/101 |
| D267,698 | S | * | 1/1983 | Domes | D8/341 |
| D268,478 | S | * | 4/1983 | Domes | D8/341 |
| 4,697,443 | A | * | 10/1987 | Hillin | 70/121 |
| 4,782,675 | A | * | 11/1988 | Thorburn | 70/129 |
| 4,796,385 | A | * | 1/1989 | Tyler | 49/280 |
| 4,997,219 | A | * | 3/1991 | Carter | 292/153 |
| 5,148,692 | A | * | 9/1992 | Gieseker | 70/290 |
| 5,868,015 | A | * | 2/1999 | Eaker | 70/129 |
| 6,227,019 | B1 | * | 5/2001 | Chhatwal | 70/93 |
| 6,557,384 | B1 | * | 5/2003 | Cuesta | 70/14 |
| 6,644,075 | B1 | * | 11/2003 | Thompson | 70/232 |
| 6,857,299 | B1 | * | 2/2005 | McNeil | 70/200 |

* cited by examiner

*Primary Examiner*—Suzanne Dino Barrett

(57) ABSTRACT

A plurality of separately keyed padlocks, ranging in number from 7 to 150 or more, are securely held within a circular assembly that is rotated for selection of a specific padlock. This assembly of locks can be placed at a level for easy reach from a car window. Visible imprinted numbers provide a quick way for authorized members of a group to locate the padlock which a specific key will open. When opened and the padlock is turned opposite a slotted bar, moving the bar actuates a separately installed automatic gate-opener for access to an area.

Figure 1:
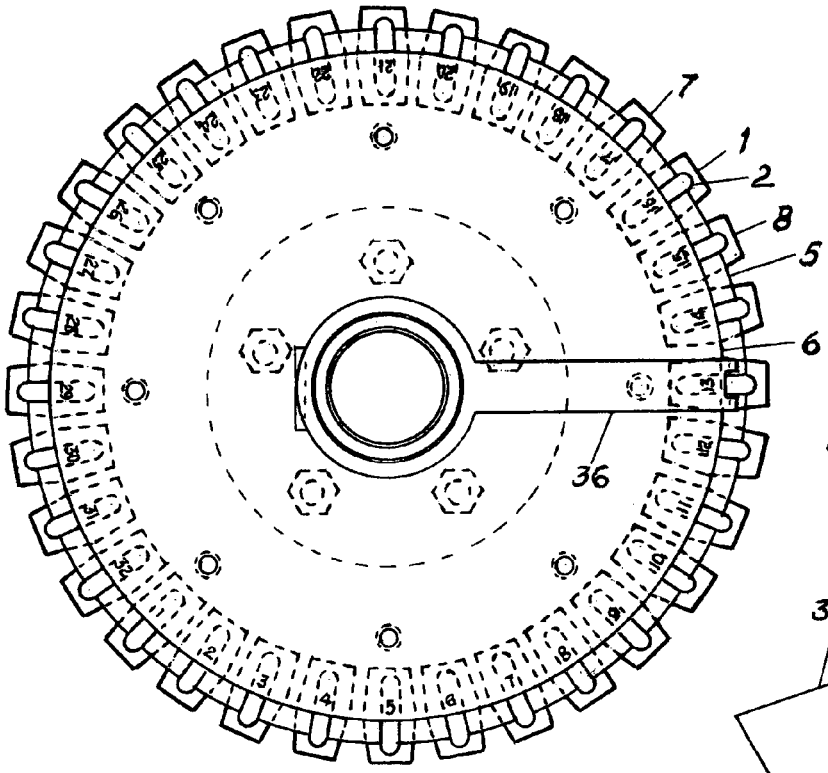

Alternatively, the system can be adapted for use manually by authorized personnel to lock or unlock a gate, door, or secured equipment.

No padlock can be removed from the assembly except for periodic changing of a lock when an individual leaves the group and thus is no longer permitted to enter the closed area. If service personnel or visitors ask to enter through the gate-opener and are so authorized, provision for such access is possible without issuing duplicate keys or installing electronic equipment.

5 Claims, 5 Drawing Sheets

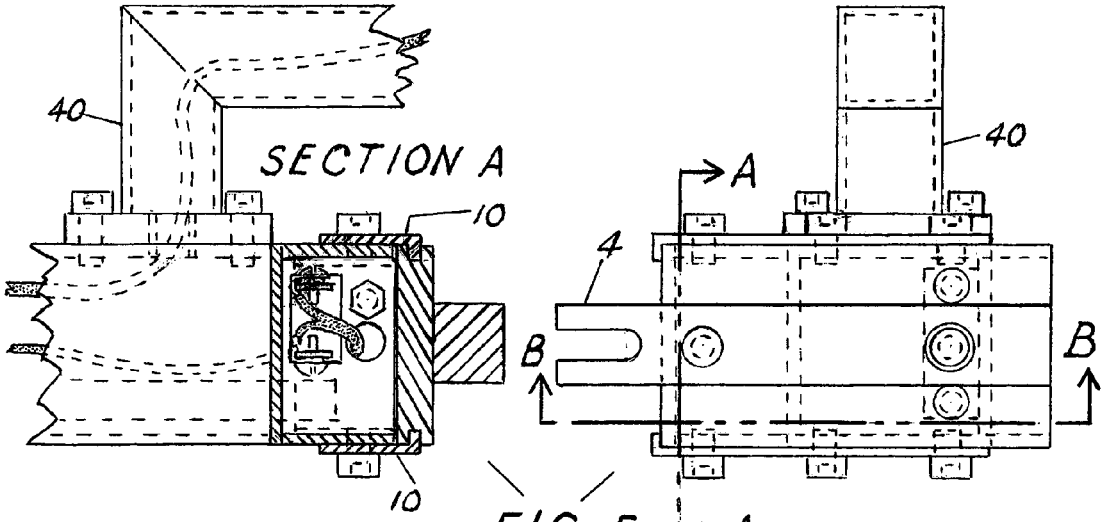
FIG. 5
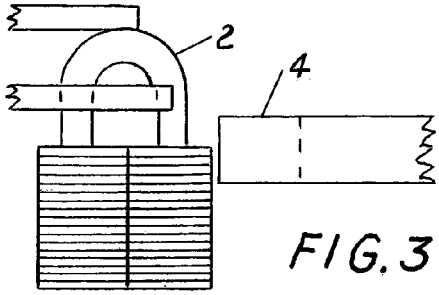
FIG. 3
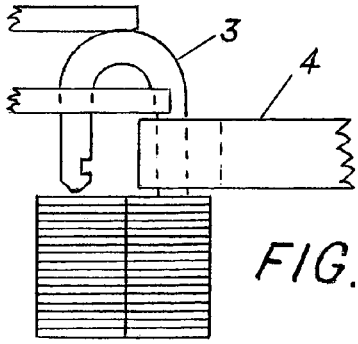
FIG. 4
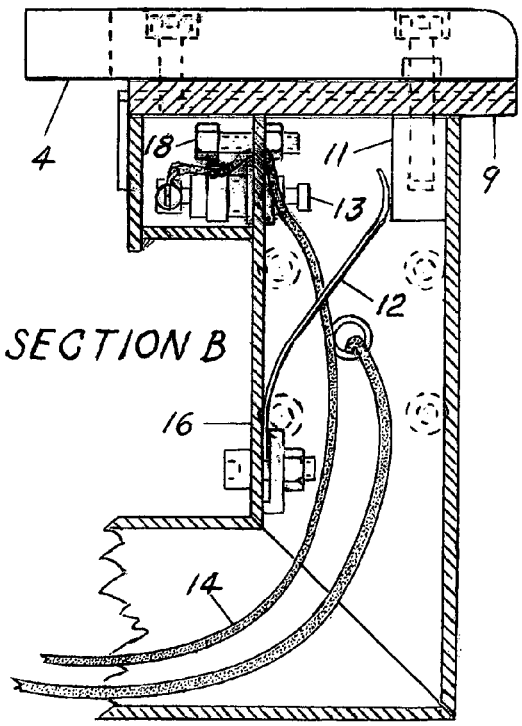

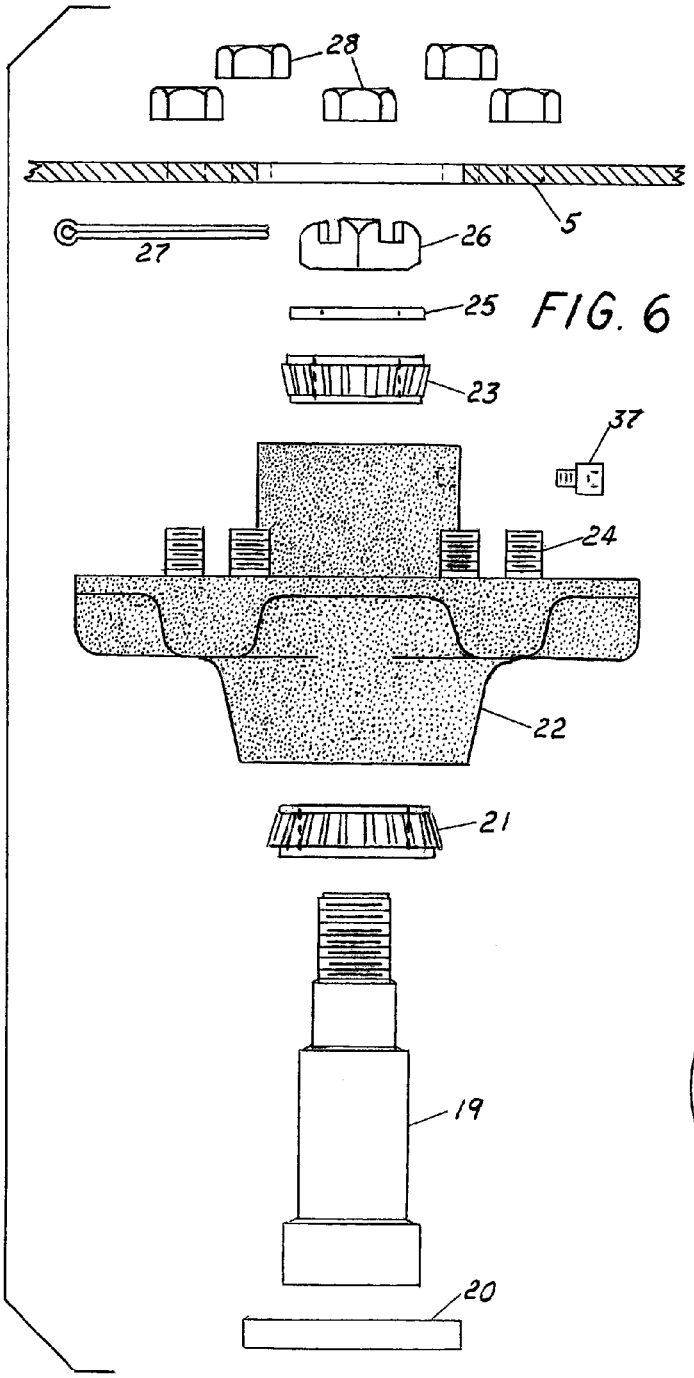
FIG. 6
FIG. 7
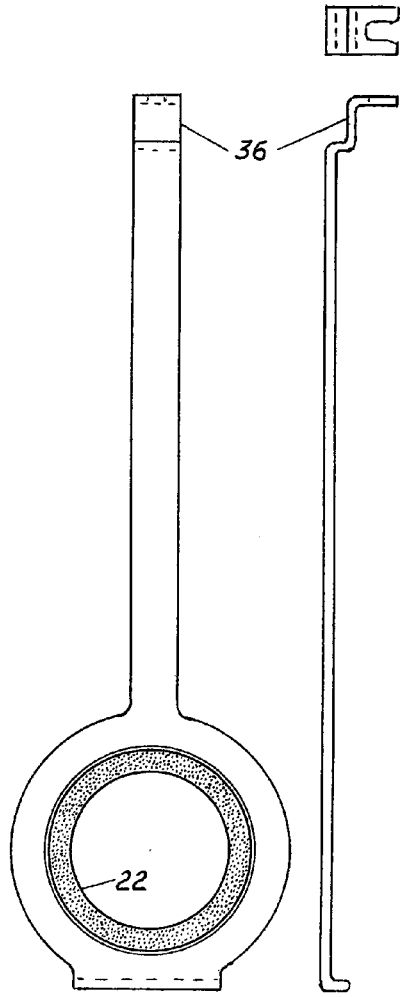

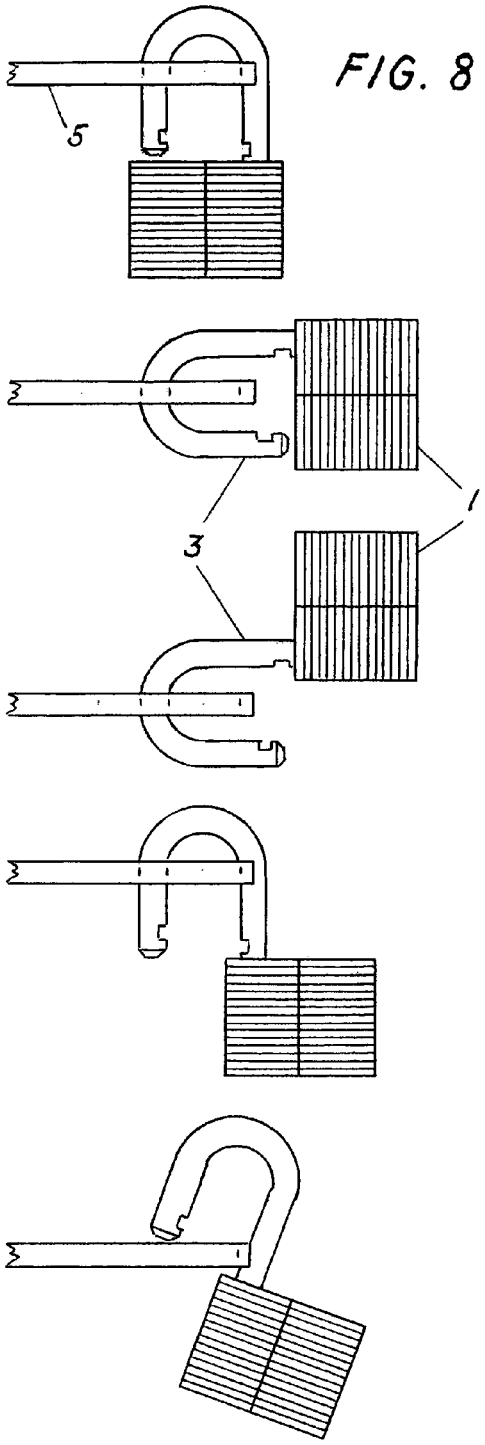
FIG. 8
FIG. 9
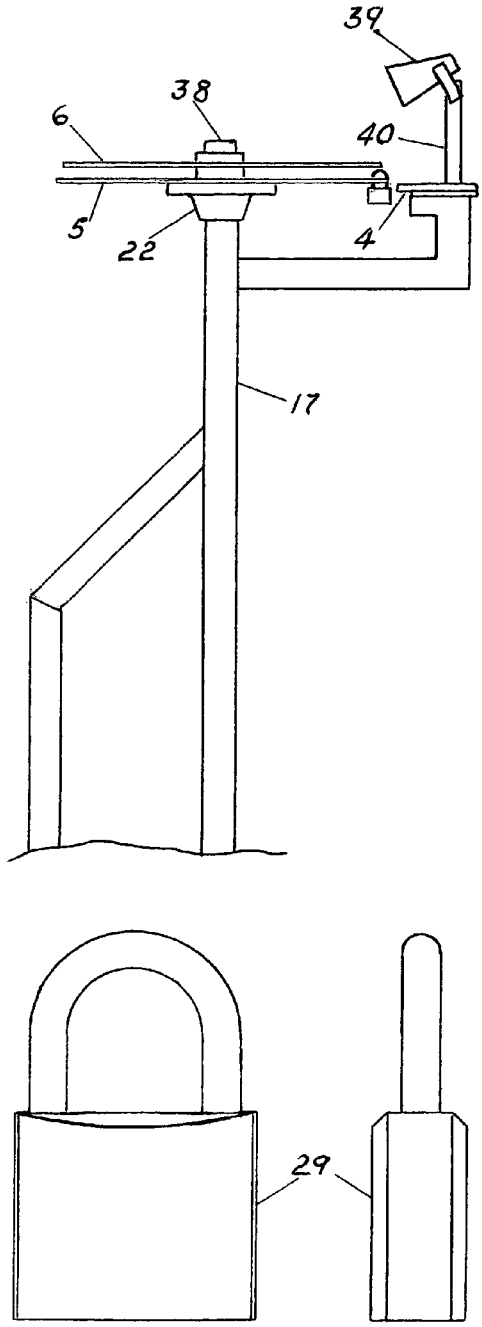

ROTARY SECURITY SYSTEM

U.S. PATENTS CITED AS REFERENCES

| Category A | Category B |
|---|---|
| 2,666,660 Youngworth | D267,698 Domes |
| 2,856,220 Easley | 2,707,125 Ritter |
| 2,963,895 Thomas | 3,656,789 Ray |
| 4,085,599 Fischer et al | 3,889,497 Tuttle |
| 4,240,278 Linder | 3,906,760 Parker |
| | 3,926,018 Joersz |
| | 3,988,031 Meyer |
| | 4,697,443 Hillin |
| | 4,997,219 Carter |
| | 5,868,015 Eaker |
| | 6,857,299 McNeil |
| | 6,557,384 Cuesta |

BACKGROUND INFORMATION

Numerous patents have been issued in past years for devices holding more than one padlock, with entry through a gate being possible when a single padlock is opened and removed. The five patents in category A of listed references provide for such action, but the devices involved contain only two padlocks. Category B lists twelve patents describing devices that contain a plurality of separately keyed padlocks, any one of which can be unlocked and removed to allow the opening of a gate.

The seventeen listed patents attest to the fact that continued security may often be required when different individuals are authorized to enter an enclosure at different times. Some might question why a duplicate of the key to a single padlock is not distributed to authorized personnel. One answer to this question came from a canoeing guide in southwest Texas whose residence was located near a river and behind a gate on the only road leading into a fenced ranch area. When asked the purpose of five different locks on a gate-locking device similar to that described by Parker (category B above), his answer was as follows: "If I give out a lot of keys to those who want to have me guide them downriver, then one of the ranch owners who objects to unrecognized intruders will soon find out about it, cut off my lock, and install another so I can't get in myself!" A rule against giving or lending copies of a key to unauthorized personnel is perhaps the main reason for wanting separately keyed locks to be used in opening and closing a gate, but there are other reasons, such as pinpointing responsibility if keys are lost, avoiding the use of expensive electronic systems that may fail to function, or for the manager of a gated area being able to change a specific lock when an individual is no longer authorized to enter, and doing so without the need to issue new keys to all other authorized entrants.

Automatic gate openers that must be actuated to open, preferably from a car window, are currently installed or being considered at the entrance to enclosed areas such as estates, ranches, private clubs, private roadways, sport facilities, home sites, retirement areas, and other locations entered by authorized personnel or their guests. One typical way to actuate a powered gate-opener is to reach from a car window and use a key to operate a switch. After entry, a powered gate-opener functions so as to close the gate automatically. To exit later, a push-button switch may be used, or a car may actuate a buried sensor that serves the purpose of an opening switch. The latter concept is becoming common.

Before listing details and advantages of the invention covered by this patent, it seems appropriate to note some of the disadvantages involved in application of what is described by the seventeen previous patents listed above.

1. The limitation of those in category A, which provide for only two separately keyed padlocks, is obvious.

2. The drawings and descriptions for patents in category B show from four to eight separately keyed padlocks, with implication that this number could be increased. But close analysis of space required between adjacent padlocks indicates that the size of each of the devices would become large and unwieldy if expanded appreciably.

3. None of the listed patents refer to, or show by a drawing, how the locking device covered by the patent could be mounted at some distance from a gate to actuate an automatic gate-opener. This apparently could not be done in a practical way by the devices described.

4. The manual effort and time to find a specific loosely hanging padlock, open and remove it from what may be cramped quarters, manipulate a device so as to withdraw the locking bar involved, open and close a gate, go through steps required to replace the padlock, and later repeat the process, would be frustrating and require added time. Some individuals would tend to pocket the padlock or place it aside, reducing the chore otherwise involved. Security would suffer, particularly if the padlock were lost or stolen.

These disadvantages would either be eliminated or greatly reduced through application of the rotary security system that will next be described.

SUMMARY

A keyed padlock is referred to herein as consisting of two components: the base, which includes an internal lock mechanism actuated by a key inserted into bottom of base, and the shackle, which consists of a steel rod that has been bent in a half-circle, forming parallel rods, the ends of which fit into holes of the base. After pushing shackle and base together, the two rods are held securely. When unlocked, spring action causes the base to extend about 7/16-inch from its locked position, with the longer of two rods remaining fixed in the base and the second arm extending free. The fact that some shackles are notched only near the end of one shackle rod for grip within the base, with others are also notched near the end of each rod, has no bearing on what is covered in this or following sections.

In past uses of a padlock, the fixed rod remains held by the base while the other rod swings so as to be removed from a hasp, or from links of a chain. Padlock function within the rotary security system is different. Shackle rods are securely held within an assembly. When the base is unlocked, it cannot swing with respect to shackle rods, but merely drops down about 7/16-inch from the assembly, exposing an increased length of the fixed shackle rod. This permits a slotted bar to move past the shackle rod, thereby initiating action intended by the rotary security system.

Although such action is entirely different from past uses of a padlock, the process involved will be clearly explained in this and the following section, and reasons why advantages result will become clear.

FIG. 1 is a top view of dual plates that are both circular, rigid, and concentric. They are secured together and rotate about an axis. Shackles of a plurality of padlocks are supported by the lower plate. An arbitrarily selected number of thirty-two padlocks, identical in shape but keyed differently, are pictured in this view. The top of two plates surmounts all shackles. Numbers stamped on the top plate serve to identify each assigned padlock. An optional pointer can be used to aid in peripheral location of a specific padlock to be opened and turned to another location, prior to action described below.

Figure 2:
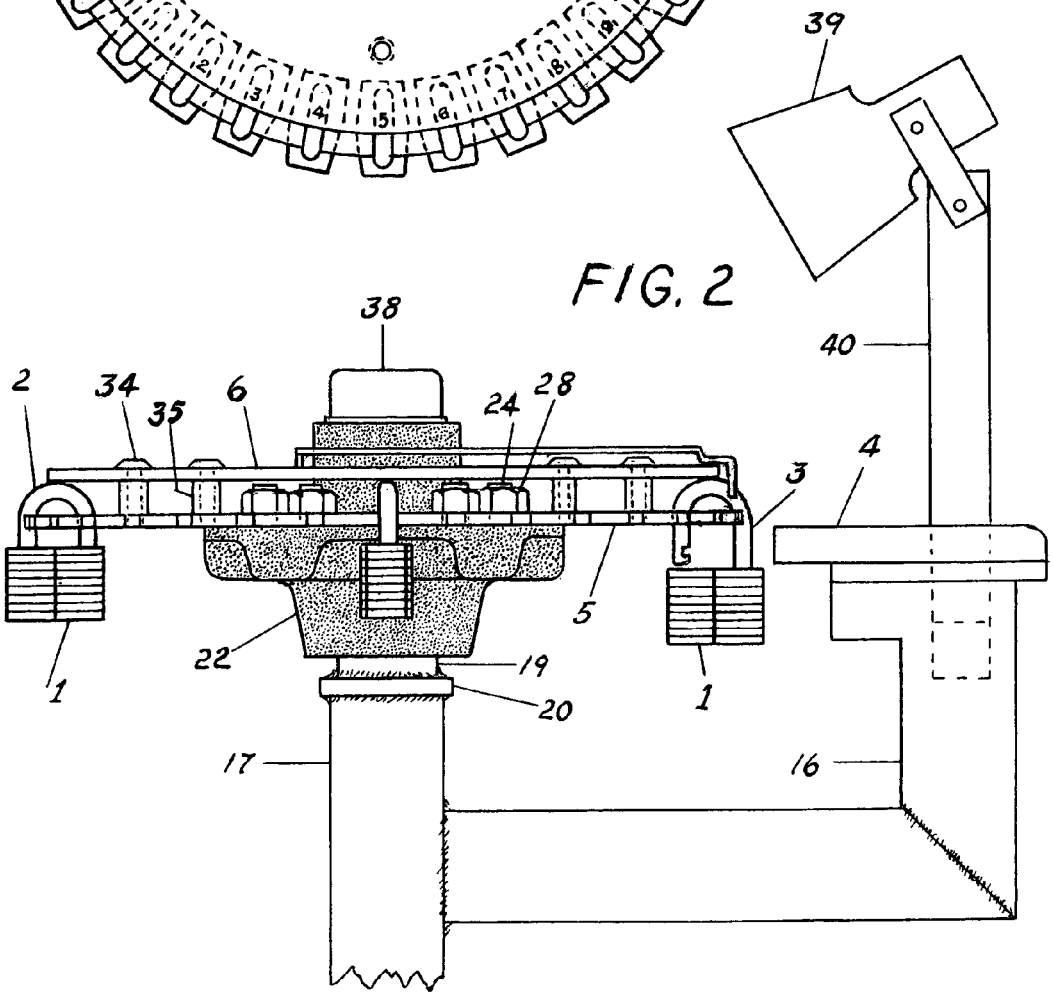

FIG. 2 shows how the lower of two plates is secured to a central hub for rotation. The swinging rod of each shackle extends through a hole in the lower plate. The other shackle rod fits within a semicircular cut at the edge of said plate. Both the hole and the semicircular cut are on a radial line from the rotational center. Capscrews or similar fasteners secure the top plate to lower plate, with each screw passing through an optional metal sleeve that facilitates tightening screws so the top plate touches the top of each shackle, thereby assuring uniform alignment of shackle rods, simplifying closure of an opened padlock with one hand, and preventing removal of any padlock. To avoid complexity of this drawing, only three of the multiple padlocks are fully pictured.

All padlocks are evenly spaced, with minimal clearance between the bases of each. The padlock on the right, at which the pointer is located, is shown after being opened so as to increase length between shackle arms and base. Doing so permits movement of a slidable bar that can actuate a powered gate-opener or initiate other action. An optional lamp provides for recognition of lock numbers at night.

FIGS. 3–5: A bar with slotted end, bolted to a slidable plate, is defined by these three figures. When all padlocks are closed, as in FIG. 3, the bar and slide can only be moved a limited distance toward any portion of the rotary assembly. When one padlock is opened with a key, as in FIG. 4, the bar and slide can be moved with one hand so as to pass an arm of the padlock shackle, thus making possible a subsequent action. FIG. 5 illustrates how an electrical push-button can be depressed by movement of the bar and slide, thereby connecting the low-voltage circuit of a typical battery-powered gate-opener. Also shown is an electrical cord for the integral lamp. Typically, both cords are entirely hidden from view, extending through support columns into the ground, thence to a low-voltage gate-opener and to any available 120-volt connection such as that for an underground sensor, commonly installed so an automatic gate-opener will be actuated by exiting cars.

FIG. 6: An exploded view shows the construction of a typical automotive trailer hub, after minor changes. With its shaft firmly held upright, this hub supports the two plates and padlocks, turning freely while minimizing vertical displacement of padlocks with respect to bar and slide noted above. Other types of spindle/hub combinations that provide a firm support would also be suitable.

FIG. 7: This is an optional pointer, one end of which fits the center of padlock rotation. The outer end is formed so it will drop over the exposed edge of a padlock shackle. One purpose of the pointer is to facilitate rotating the assembly so an opened padlock will be opposite the slotted bar. A less definite purpose is to indicate the lock number utilized by a previous user of the rotary system, thereby helping to identify who may have given a key to an unauthorized person.

FIG. 8: When an individual is found to have violated stated rules about giving keys to others, or has gone elsewhere without returning a key, it may be determined that the lock corresponding to that individual's key must be changed. If there were one lock and the same key for everyone, this would require transmitting a new key to all involved. By interchanging one padlock with another not yet in use, the rotary security system removes the need to change all keys. FIG. 8 illustrates how specific padlocks can be removed easily from the lower plate after disassembly of the surmounting plate by an authorized person. Without such disassembly, no padlock can be removed.

FIG. 9: Provided that the sizes of lower and surmounting plates are determined correctly, and the hub adequately supports weight of plates plus padlocks, any desired number of padlocks can be utilized with the rotary system. In FIG. 1, the diameter of plate holding 32 padlocks was 12.4 inches. The lower illustration in FIG. 9 shows a commonly available brass padlock with narrower base. One hundred such padlocks can be assembled between concentric plates having a diameter of 21 inches. The top drawing of FIG. 9 shows the outline of a system of that size, mounted at car-window height.

Figure 10:
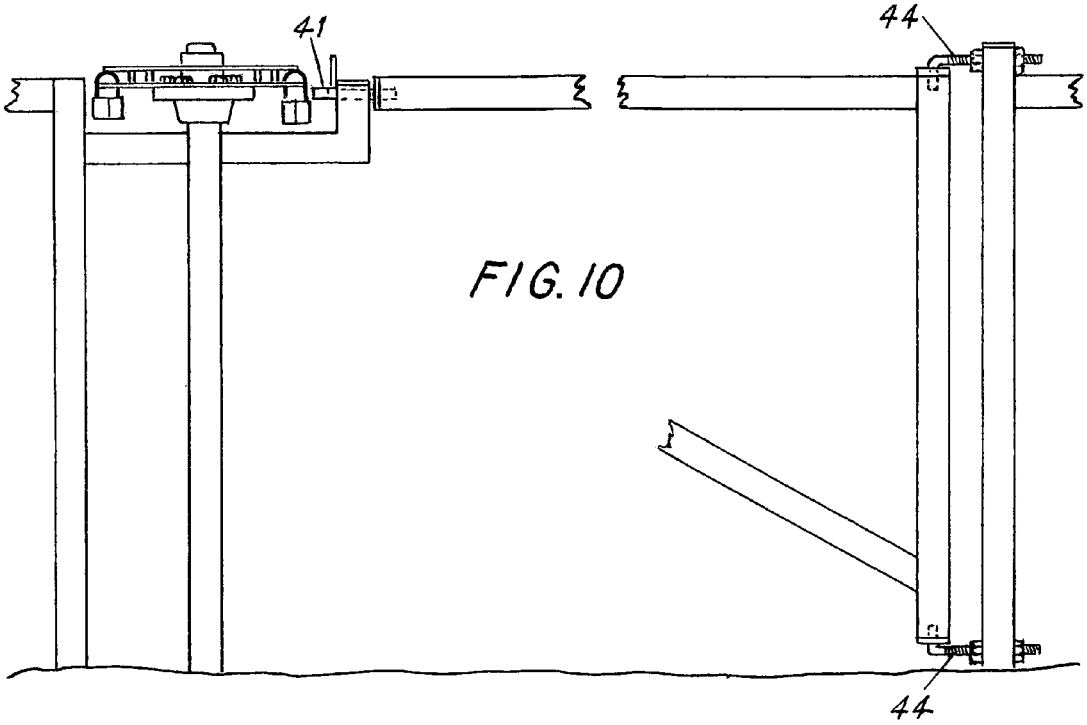
Figure 11:
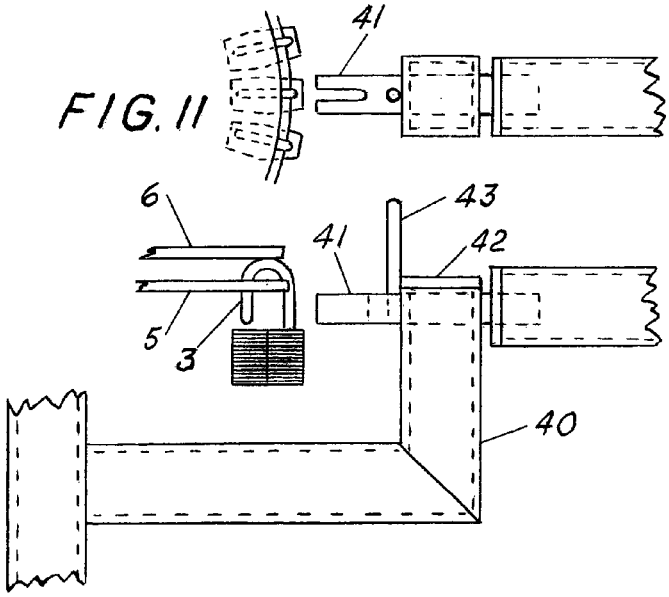

FIGS. 10, 11: When used as a manually operated gate opener, design of the rotary security system can be simplified while retaining its basic functional method and corresponding advantages. FIG. 10 shows how the 32-padlock system of FIGS. 1 and 2 can be installed in this way so as to lock or unlock a gate. FIG. 11 is an enlarged illustration of the same gate latch. By using a narrower spindle and hub, the system will also function properly with about seven padlocks installed. Since not all of these must be assigned to a user, there is no lower limit to the number of those authorized to enter a gated enclosure protected by this system.

Figure 12:
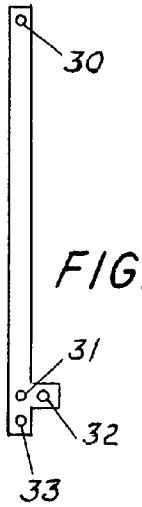

FIG. 12. Details that follow will explain how this simple drill jig can be used to drill holes easily and precisely in the lower plate.

Allowing visitors or service personnel to enter a secured area. A standard type of combination padlock, or a push-button locking box, affixed to framework of the rotary security system can hold a chained key for one of the system's padlocks. This provides a way for visitors or service personnel to be given by phone the four digits and lock number that will allow them to use the key for entry into the secured area. Digits required to open the combination padlock or locking box can be changed to avoid breach of security. A drawing is not required to illustrate this concept.

DETAILED DESCRIPTION

FIG. 2 illustrates a unique feature of the rotary security system that evolves from a padlock function not ordinarily considered. The closed padlock (base 1 and shackle 2) clearly has less distance between top of its base and bottom of plate 5 than does the opened padlock (base 1 and shackle 3). The increased distance after opening varies somewhat according to padlock size and design. Commonly it is from ⅜ to 7⁄16 of an inch. This difference in length is sufficient to allow for functions unique to this invention, as descriptions that follow will indicate.

Bar 4, shown in FIGS. 2,3,4,5, and 9, has a slot about 1⁄32-inch wider than shackle rod diameter, so that the bar can be moved to enclose and extend beyond the outer arm of shackles that are held securely by plates 5 and 6. Depending on action intended after movement of bar 4, this slot can be long enough for the bar to enclose or pass the second bar of shackle 3. Both the vertical width and horizontal width of bar 4 must be such that the bar can move only an incremental distance unless a specific padlock has been opened and located in front of the bar. FIG. 3 shows that bar movement would be stopped by the base of a closed padlock. FIG. 4 shows the bar extending past an arm of shackle 3 when the padlock is open and its base has dropped. With reference to FIG. 1, horizontal width of bar 4 (not pictured in FIG. 1) must be narrow enough so it will pass easily between bases on either side of an opened padlock, such as bases 7 and 8 when the padlock between them is open. Horizontal width must be wide enough so it cannot be moved between any two adjacent padlocks that are closed. Vertical width of bar 4 must be such that the bar cannot pass between plate 5 and base 1 when the padlock is closed, but can easily pass between plate 5 and base 1 when the padlock has been opened. It is not possible to list specific vertical and horizontal width dimensions of bar 4, since padlocks vary in design, and their assembly within rotary security systems may also vary.

All padlocks for a rotary security system must be of the same design and size, although the cut of their keys differ, as is normally the case. Since there are numerous key-cut combinations, adhering to one design and shape of padlocks utilized can be termed an advantage, because choice and purchase of a padlock would not be required of individuals who are authorized to use the rotary system.

Various actions can be incorporated into the system when bar 4 is moved as described above. One recommended action is illustrated by FIG. 5, which consists of a top view and two sectional views. Bar 4 is secured with capscrews to slide 9, which is retained and guided by angular strips 10. Rectangular block 11, bolted to the base of slide 9, serves four functions: Block 11 prevents the slide from being removed. Block 11 provides a push-point for spring-arm 12, which acts to return the slide. Block 11 depresses push-button switch 13 after a predetermined movement distance of slide 9, thereby making possible the actuation of an electrically powered gate-opener or other electrical device. Low-voltage wiring 14 connects to the push-button. Block 11 contacts adjustable bolt 18, thus preventing damage to switch 13. After bar 4 is moved with one hand until contact between block 11 and bolt 18 occurs, the hand is free to close the opened padlock by squeezing it between thumb and fingers.

A description follows next of the rotating assembly pictured first in FIGS. 1 and 2. The spindle and hub of this assembly is shown in the exploded view of FIG. 6. This specific design involves only minor alterations of what is commonly sold by auto parts stores as a trailer hub. Said hub was selected for three reasons: low cost; turning on roller bearings, and wide support so as to secure plate 5 with minimal vertical displacement as the assembly shown by FIG. 2 is rotated. One end of spindle 19 may require shortening from its purchased length, for welding to plate 20, which is later welded to support column 17. Tapered roller bearings 21 and 23, FIG. 6, fit on the spindle and within the machined center of hub 22. Five bolts supplied with a trailer hub are cut to required length. The hub assembly is completed by attaching washer 25, nut 26, and cotter pin 27. Lubrication of bearings can be less than on a road vehicle. As shown in the partial cross-sectional view of lower plate 5, FIG. 6, plate 5 is secured to the hub with nuts 28.

Plate 5, on which the selected padlocks are assembled, requires a dimensional layout for drilling two holes per padlock. Several variables must be considered in preparing for the layout. The number of padlocks required is determined from the maximum number to accommodate personnel authorized to separately use the radial security system. If that number is between 20 and about 50, padlocks having a wider base are suitable, such as denoted by 1 in FIGS. 1 and 2. For a larger required number of padlocks, the selection of relatively narrow brass padlocks will minimize plate diameter. These are depicted by 29, FIG. 9. For numbers less than 20, a smaller hub design is normally required. Such a hub can be as simple as a straight spindle within a close-fitting tube having a projecting flange two or three inches in diameter.

Padlocks should hang on plate 5 with only enough clearance between their bases to permit a base to drop from its shackle when a padlock is opened. For example, if the center of the base for padlock 29, FIG. 9, measures 9/16 of an inch in width, then the inner holes of plate 5 can properly be 5/8 of an inch apart, center to center. If 50 locks were required, simple calculations show the circular diameter between centers of inner holes of plate 5 to be 9.95 inches. Continuing the example, if shackle width, center to center of shackle rods, is 1.15 inches, then the outer diameter of plate 5 would be 12.25 inches. Note that outer holes of plate 5 are half-circles only, but such holes would normally be drilled or punched before plates are cut to size.

After such routine calculations, the layout of holes in plate 5 can be simplified by first making the simple drill jig shown by FIG. 12. To continue above example, assume that shackle rod diameter was found to be 0.255 inches, and trial on a short strip of steel, equal in thickness to that of plate 5, showed that 5/16-inch drilled inner holes and outer semicircular cuts formed from 17/64-inch drilled holes would barely permit turning the shackle as in FIG. 8. Holes 31 and 32 of FIG. 12 would then be carefully spaced and drilled to the 5/16-inch diameter. Hole 33 would be cut with a 17/64-inch drill. Hole 30 is needed so the jig can be pivoted around a rod placed within a matching hole at the center of plate 5. The steps for clamping the jig and drilling holes in plate 5 are obvious. A suggested step is to allow for one more set of padlock holes than initially determined—51 rather than 50 in above example. By doing so, if hole spacing with the drill jig does not end precisely, then bolting an obstruction in the last hole will not hinder later use of the system. Of course, careful use of a pointed divider tool would serve to locate all holes precisely, and a template or circular drill jig, prepared for continued production of specific hole locations, would simplify the work involved.

Remaining steps for completion of plate 5 consist of smoothly cutting the diameter to produce half-circles in outer holes, cutting out the center to fit hub 22, and drilling for the five bolt-holes. The center hole and bolt holes can be cut oversize, to assist in centering plate 5 when it is assembled.

The diameter of plate 6 is such that the plate will extend about 1/4 inch past the top center of all shackles. If desired, capscrews can be used which are longer than shown in 34, FIG. 2, with fiber lock-nuts below plate 5. The length of optional sleeves 35 should be about the same as the height of padlock shackle tops above plate 5. The use of pointer 36, shown in FIG. 7, is optional for the following reason: The location of an opened lock opposite bar 4 can be approximate, since movement of the slot of bar 4 toward a circular shackle rod automatically corrects some misalignment, particularly if the inside edges of the slot in bar 4 are tapered. The slot at end of pointer should fit loosely over the top of shackles. One or more of capscrew 37, FIG. 6, can be inserted into threaded holes at the top of hub 22, thereby thwarting later removal of pointer. Insertion of grease-cap 38 completes assembly of the rotating unit.

Lamp 39 is optional, depending in part on whether 120-volt current is available. Lamp-arm 40 can be of a shape best suited for attachment of the lamp, and is secured to support-arm 16 with capscrews. Wiring passes through support-arm 16, support-column 17, and normally continues below the ground to required connections. Lamp wires may be connected to those for an underground sensor that opens the gate when a car exits enclosed area.

FIG. 10 illustrates how the rotary security system can be adapted for manually locking and unlocking the entrance to an enclosure. No reference numbers are shown on the rotary system in the drawing of FIG. 10 because its size, as pictured by the drawing, is similar to that shown by FIG. 2. Gate and fence structures in this drawing are intended to be symbolic only. Support-column 40 differs from support-column 16 of FIG. 2, requiring only vertical cuts at the top. Cap 42 is welded to support-column 40. Sliding bar 41 is configured the same as bar 4 on the end facing the rotary assembly, although the slot of bar 41 may require a longer length unless the gate or door is known to remain closely fitted against support-column 40. Rod 43 not only assists in gate entry or exit, but it also prevents removal of sliding bar 41. Adjustable pivot supports 44 are commonly available and may be required for gate adjustment to assure smooth latching action.

Recommendations are next listed concerning material requirements for specific parts. These recommendations are intended to be flexible, depending on where the rotary security system will be installed. In general, padlocks are known to be weather-resistant, suitable for outdoor use. A simple cover for the rotating assembly can be made for use where climatic conditions are severe. As noted above, plate 5 can properly be about ¼" thick, with stainless steel preferable for appearance. Plate 6 can be of ⅜" thick aluminum, providing sufficient edge thickness for imprinted lock numbers. Supporting columns and structures shown in various figures from 1 to 11 can properly be made from 2×2-inch square steel tubing, welded where appropriate and painted to resist corrosion. Wall thickness of the square tubing should be selected to assure both columnar support and required tapping of holes in column 16. Bar 4 can be of rust-resistant metal, selected so that deformation of the slotted end is not likely to occur. Consider brass for slide 9 and angular strips 10.

Operation of the rotary security system becomes routine and easy after a person not familiar with it is shown the simple steps required. It is recommended that brief instructions be affixed where they can easily be seen. Suggested wording for actuating an automatic gate-opener from car window is as follows: 1. Use your key to unlock assigned lock. 2. Rotate so base of lock is opposite slotted bar. 3. Push bar past rod of lock. 4. Close lock and drive through opened gate.

What I claim as my invention is as follows:

1. A rotary security system for use by any one of a plurality of authorized individuals, either to actuate a powered gate opener or as a manually operated lock for a gate or door for stationary equipment, the system comprising:

a plurality of padlocks, each of the plurality of padlocks comprising a U-shaped shackle having two legs, and a base having a lock mechanism therein, wherein each of the plurality of padlocks having the shackle and base of the same size and shape;

a circular plate having a plurality of notches and a plurality of holes formed therein;

wherein the plurality of notches are formed around a perimeter of the plate, the number of notches corresponding to the number of padlocks, wherein each notch is sized to receive one leg of a corresponding padlock shackle therein;

wherein the number of holes corresponding to the number of padlocks and each hole is positioned adjacent to a corresponding notch, each hole is sized to receive the other leg of the corresponding padlock shackle therein, each padlock is arranged such that one leg of the shackle is received in the hole and the other leg of the shackle is received within the notch;

a surmounting plate spaced from and affixed to the circular plate, wherein the surmounting plate is positioned such that the surmounting plate prevents removal of each padlock shackle positioned within the corresponding notch and hole in the circular plate;

wherein in assembly, each padlock is positioned such that the base is disposed on one side of the circular plate and the shackle is captured between the circular plate and the surmounting plate;

wherein each of the padlocks having a locked position and an unlocked position, wherein in each of the locked position and the unlocked position, the shackle remains in the corresponding notch and hole in the circular plate, and wherein in the locked position, the base is in a first position adjacent the circular plate and in the unlocked position, the base is in a second position spaced from the circular plate;

a slidable lock bar having a notched end, wherein the slidable bar in a locked position abuts the padlock base, when the base is in the locked first position, preventing opening of a gate, and when the base is in the unlocked second position, the lock bar is slidable to an unlocked position such that the notched end receives the shackle leg;

the circular plate and surmounting plate rotatably mounted to a spindle and hub assembly attached to a hollow columnar support, and the slidable lock bar mounted to a frame assembly which is attached to the columnar support;

the circular plate further having indicia thereon corresponding to each padlock.

2. The rotary security system of claim 1, wherein the slidable lock bar is disposed within a retaining framework to prevent tampering, and such that the slidable lock bar is limited in movement to a horizontal sliding between the locked and unlocked positions.

3. The rotary security system of claim 1, further comprising a powered gate opener, being equipped with an electrical switch or electronic device, either of which is actuated by a movement of the slidable lock bar, with said switch or device connected by wiring through the hollow frame and columnar support and disposed in a weatherproof housing.

4. The rotary security system of claim 1 further comprising a manually operated lock for a gate or door, wherein the slidable bar having a length that extends beyond the framework opposite the notched end to serve as a lock bar for a gate or door, such that the lock bar cannot be withdrawn until one of the padlocks on the rotary security system is unlocked and opened.

5. The rotary security system of claim 1 further comprising a combination or key lock box secured adjacent the columnar support and having a padlock key affixed therein, such that authorized service personnel may be given the combination code in order to access the specific padlock key and gain entry through the rotary security system to the secured gate, door or equipment.

* * * * *